US012491421B2

(12) United States Patent
Ting

(10) Patent No.: US 12,491,421 B2
(45) Date of Patent: Dec. 9, 2025

(54) BICYCLE TRAINER

(71) Applicant: MEGA JOY ENTERPRISE CO., LTD., Taichung (TW)

(72) Inventor: Shih-Fu Ting, Taichung (TW)

(73) Assignee: MEGA JOYENTERPRISE CO, . LTD, Taichung (TW)

( * ) Notice: Subject to any disclaimer, the term of this patent is extended or adjusted under 35 U.S.C. 154(b) by 75 days.

(21) Appl. No.: 18/629,182

(22) Filed: Apr. 8, 2024

(65) Prior Publication Data

US 2024/0342571 A1 Oct. 17, 2024

(30) Foreign Application Priority Data

Apr. 12, 2023 (CN) ..... 202320800276.2

(51) Int. Cl.
*A63B 69/16* (2006.01)
*A63B 22/02* (2006.01)
*A63B 24/00* (2006.01)

(52) U.S. Cl.
CPC ..... *A63B 69/16* (2013.01); *A63B 22/025* (2015.10); *A63B 24/0062* (2013.01); *A63B 24/0087* (2013.01); *A63B 2069/167* (2013.01); *A63B 2220/803* (2013.01); *A63B 2220/833* (2013.01)

(58) Field of Classification Search
CPC ... A63B 22/025; A63B 22/0257; A63B 22/02; A63B 69/16; A63B 24/0062; A63B 24/0087; A63B 2069/167; A63B 2069/168; A63B 2069/164; A63B 2069/163; A63B 2220/833; A63B 2220/803; A63B 2220/801; A63B 2220/30; A63B 2220/13; A63B 2024/0093
See application file for complete search history.

(56) References Cited

U.S. PATENT DOCUMENTS 6,530,864 B1 * 3/2003 Parks ..... A63B 69/16 482/61
7,604,575 B2 * 10/2009 Papadopoulos ..... A63B 69/16 482/61

(Continued)

FOREIGN PATENT DOCUMENTS

TW M535584 U 1/2017

*Primary Examiner* — Megan Anderson
*Assistant Examiner* — Jonathan A Dicuia
(74) *Attorney, Agent, or Firm* — Birch, Stewart, Kolasch & Birch, LLP

(57) ABSTRACT

A bicycle trainer includes an electric treadmill, a controller, and a sensing unit. The electric treadmill includes an endless conveyor belt on which a user may ride a bicycle. The controller is used to control a running speed of the endless conveyor belt. The sensing unit includes a swinging member and a sensor electrically connected with the controller for sensing a swing of the swinging member and sending a corresponding signal in responsive to the swing. The swinging member is disposed across the electric treadmill and swingable back and forth relative to the electric treadmill, such that the swinging member is pushable by a bicycle wheel to swing. The controller adjusts the running speed of the endless conveyor belt based on the corresponding signal. As such, the endless conveyor belt can match the instant riding speed of the user, thereby providing good riding training and experience.

5 Claims, 8 Drawing Sheets

(56) References Cited

U.S. PATENT DOCUMENTS

| | | | | |
|---|---|---|---|---|
| 2002/0055422 | A1* | 5/2002 | Airmet | A63B 22/16 482/61 |
| 2010/0234188 | A1* | 9/2010 | Wan | A63B 21/15 482/61 |
| 2017/0136289 | A1* | 5/2017 | Frank | A63B 21/4035 |
| 2018/0369675 | A1* | 12/2018 | Papadopoulos | A63B 69/16 |

* cited by examiner

BICYCLE TRAINER

BACKGROUND OF THE INVENTION

1. Field of the Invention

The present invention relates generally to bicycle trainers and more particularly, to a bicycle trainer having an endless conveyor belt, on which a user may ride a bicycle for riding training.

2. Description of the Related Art

Nowadays, there are many types of bicycle trainers available on the market. These bicycle trainers are mainly used for users to conduct an indoor cycling training or doing the cycling training in a limited space. That is, practicing in-site riding on the bicycle trainer by using a general traveling bicycle.

Taiwan Patent No. M535584 discloses a bicycle trainer, which typically involves providing a passive roller assembly and a transmission belt within a frame. The passive roller assembly usually includes three rollers, two of which are used to position the rear wheel of the bicycle, and the other roller is used to position the front wheel of the bicycle. When the user rides a bicycle on the bicycle trainer, the front and rear wheels of the bicycle drive the rollers to rotate, allowing the user to smoothly ride the bicycle in site on the bicycle trainer, thereby achieving the effect of training balance and cardiovascular endurance. Additionally, there are similar bicycle trainers available on the market, which further include a mounting device to secure the rear wheel of the bicycle, preventing the bicycle from tipping over or running off the bicycle trainer. Furthermore, as provided in the aforementioned patent, conventional bicycle trainers may also include a resistance adjustment device to apply adjustable resistance to the bicycle, thereby increasing the intensity of muscle strength and cardiovascular endurance training.

However, the drawbacks of the aforementioned bicycle trainers lie in that the bicycle runs on rollers, which differs considerably from the actual sensation of riding on the road, resulting in poor simulation of actual riding effects. Secondly, even in adjustable training mode bicycle trainers, they mainly achieve the adjustment of training intensity by adjusting resistance, without the ability of doing riding training in cooperation with the riding speed of the rider.

SUMMARY OF THE INVENTION

The present invention has been accomplished in view of the above-noted circumstances. It is an objective of the present invention to provide a bicycle trainer, which can match the user's riding speed for riding training and achieve good riding simulation effects.

To attain the above-mentioned objective, the present invention provides a bicycle trainer comprises an electric treadmill, a controller, and a sending unit. The electric treadmill includes a base, an endless conveyor belt disposed on the base, and an actuator driving the endless conveyor belt to run cyclically. The electric treadmill defines a front direction and a rear direction, and is configured for a user to ride a bicycle on the endless conveyor belt facing the front direction. The controller is electrically connected with the actuator of the electric treadmill to control an operation of the actuator to thereby control a running speed of the endless conveyor belt. The sensing unit comprises at least one swinging member and at least one sensor electrically connected with the controller for sensing a swing of the at least one swinging member and sending a corresponding signal in responsive to the swing to the controller. The at least one swinging member is disposed across the electric treadmill and swingable back and forth relative to the electric treadmill, such that the at least one swinging member is pushable by a bicycle wheel to swing. The controller adjusts the running speed of the endless conveyor belt based on the corresponding signal transmitted from the at least one sensor.

In this way, the bicycle trainer of the present invention allows the user to ride a bicycle on the endless conveyor belt, which can produce a feeling similar to that of actual riding on the road, so the effect of simulating actual riding is good. In addition, the bicycle trainer of the present invention can control the running speed of the endless conveyor belt through the controller to provide a riding speed that the user wants to train. Furthermore, when the user does riding training on the bicycle trainer to increase (or decrease) the riding speed to cause a considerable difference between the riding speed of the bicycle and the running speed of the endless conveyor belt, the swinging member of the sensing unit will be pushed by the bicycle wheel to swing, thus causing the controller to accordingly adjust the running speed of the endless conveyor belt to match the instant riding speed of the user. This not only prevents the bicycle from rushing out of the bicycle trainer to cause danger, but also allows the user to adjust the riding speed during the training process to achieve a good riding training effect.

Preferably, the at least one swinging member of the sensing unit may comprise a first swinging member and a second swinging member, which are configured in a way that the bicycle wheel is located between the first and second swinging members when the bicycle is placed on the endless conveyor belt. The at least one sensor of the sensing unit may comprise first and second sensors for sensing swings of the first and second swinging members and sending first and second corresponding signals in responsive to the swings of the first and second swinging members to the controller, respectively. In this way, the controller may adjust the running speed of the endless conveyor belt based on the first corresponding signal or the second corresponding signal when the bicycle wheel pushes the first swinging member or the second swinging member.

Preferably, the first and second swinging members may be arranged in a way that the first sensor is closer to a front end of the electric treadmill than the second swinging member is. When the first swinging member swings forward, the controller increases the running speed of the endless conveyor belt based on the first corresponding signal transmitted by the first sensor, and when the second swinging member swings backward, the controller decreases the running speed of the endless conveyor belt based on the second corresponding signal transmitted by the second sensor. In this way, the controller may increase or decrease the running speed of the endless conveyor belt when the bicycle wheel pushes the first sensor or the second sensor.

Preferably, the first and second swinging members each may comprises two support rods pivotally mounted on two opposite sides of the base of the electric treadmill, and a transverse rod connected with the two support rods in a way that the transverse rod spans above the endless conveyor belt for being pushed by the bicycle wheel to cause the support rods to swing simultaneously. The base of the electric treadmill may be provided with a plurality of stoppers in a way that one of the stoppers is located adjacent to a rear side of one of the support rods of the first swinging member, and one of the stoppers is located adjacent to a front side of one of the support rods of the second swinging member. As such, because of the arrangements of the stoppers, the first swinging member cannot swing backwards and the second swinging member cannot swing forwards.

Preferably, the sending unit may comprise a third swinging member and a third sensor. The third swinging member is arranged in a way that the third swinging member is closer to the rear end of the electric treadmill than the second swinging member is. The third sensor is adapted for sensing a swing of the third swinging member and sending a third corresponding signal in responsive to the swing of the third swinging member to the controller. When the third swinging member swings backward, the controller stops the endless conveyor belt based on the third corresponding signal transmitted by the third sensor. As such, the third swinging member may serve as an emergency stop switch.

Preferably, the height of the third swinging member is higher than that of the second swinging member. As such, when the bicycle wheel moves backwards suddenly and quickly, the bicycle wheel may bump the third swinging member to stop the endless conveyor belt.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
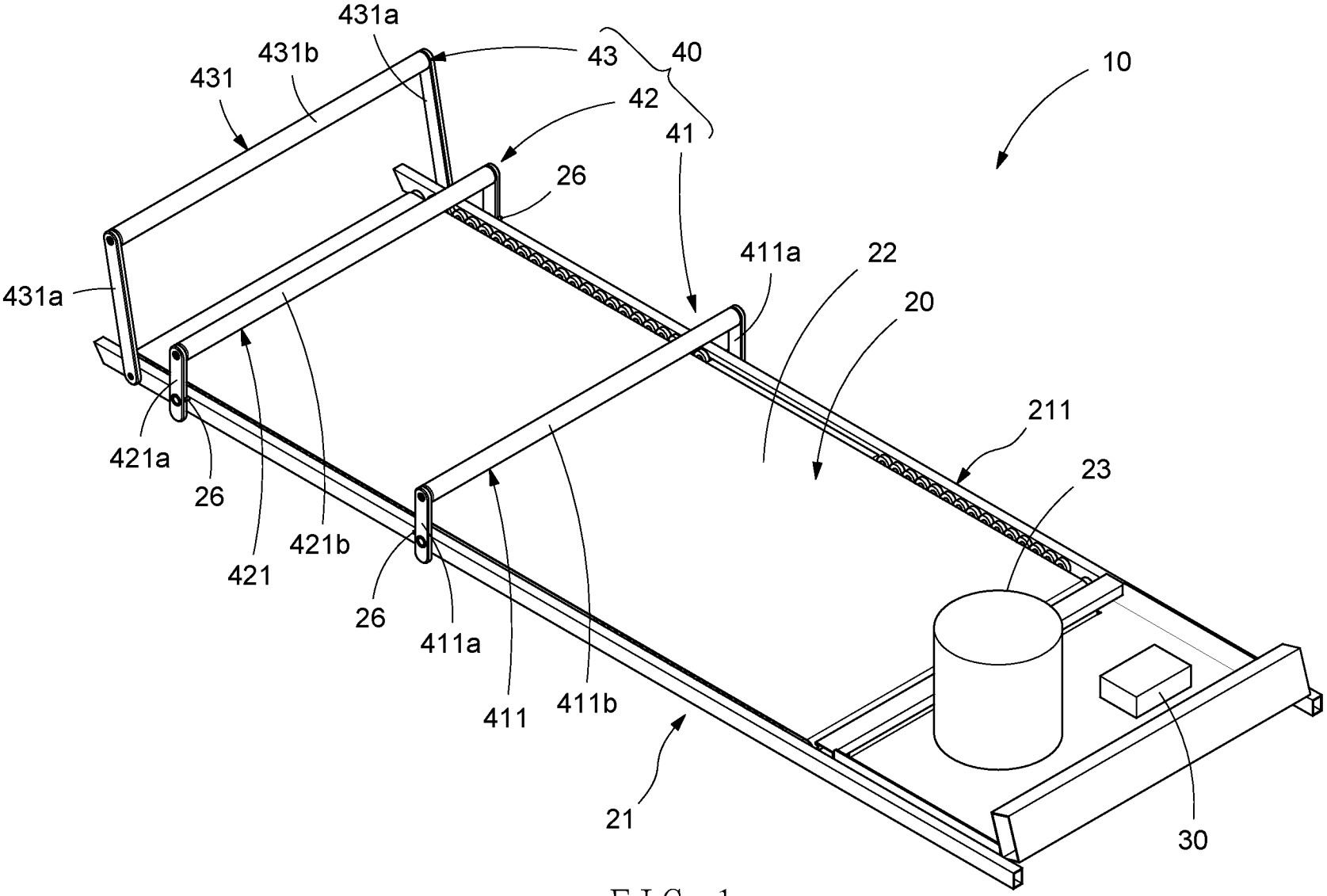
FIG. 1 is a schematic perspective view of a bicycle trainer according to a preferred embodiment of the present invention.

First of all, it is to be mentioned that same or similar reference numerals used in the following embodiments and the appendix drawings designate same or similar elements or the structural features thereof throughout the specification for the purpose of concise illustration of the present invention. It should be noticed that for the convenience of illustration, the components and the structure shown in the figures may not be drawn according to the real scale and amount, and the features mentioned in each embodiment can be applied in the other embodiments if the application is possible in practice. Besides, when it is mentioned that an element is disposed on another element, it means that the former element is directly disposed on the latter element, or the former element is indirectly disposed on the latter element through one or more other elements between aforesaid former and latter elements. When it is mentioned that an element is directly disposed on another element, it means that no other element is disposed between aforesaid former and latter elements.

Figure 2:
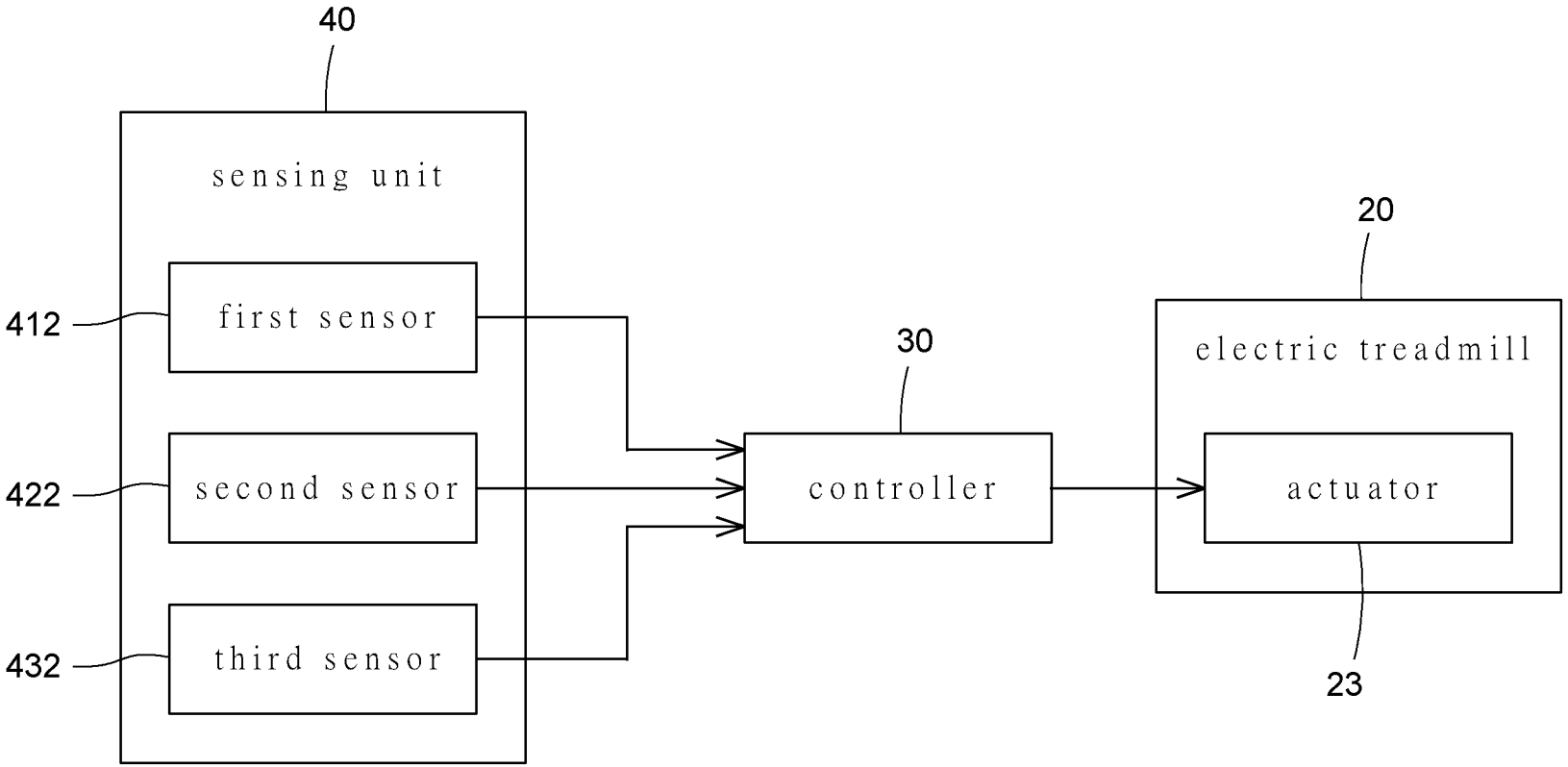
FIG. 2 is a block diagraph of a control system of the bicycle trainer according to the preferred embodiment of the present invention.
Figure 3:
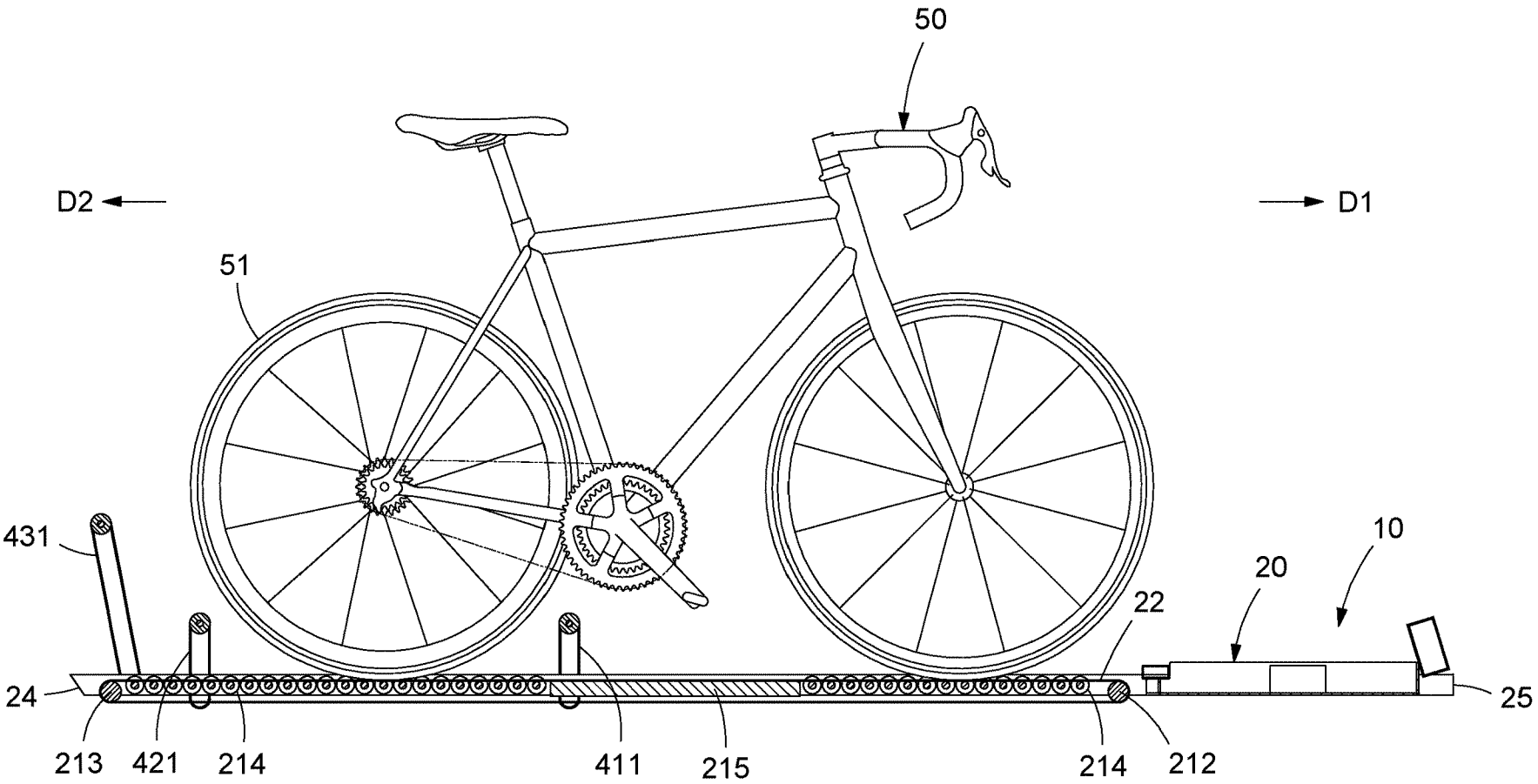
FIG. 3 is a schematic sectional view of the bicycle trainer of the preferred embodiment of the present invention, showing a bicycle is placed on the endless conveyor belt.

Referring to FIGS. 1-3, a bicycle trainer 10 according to a preferred embodiment of the present disclosure are mainly composed of an electric treadmill 20, a controller 30, and a sensing unit 40. The electric treadmill 20 defines a front direction D1 and a rear direction D2, and when using the bicycle trainer 10, the user positions the handle of the bicycle 50 towards the front direction D1.

Figure 4:
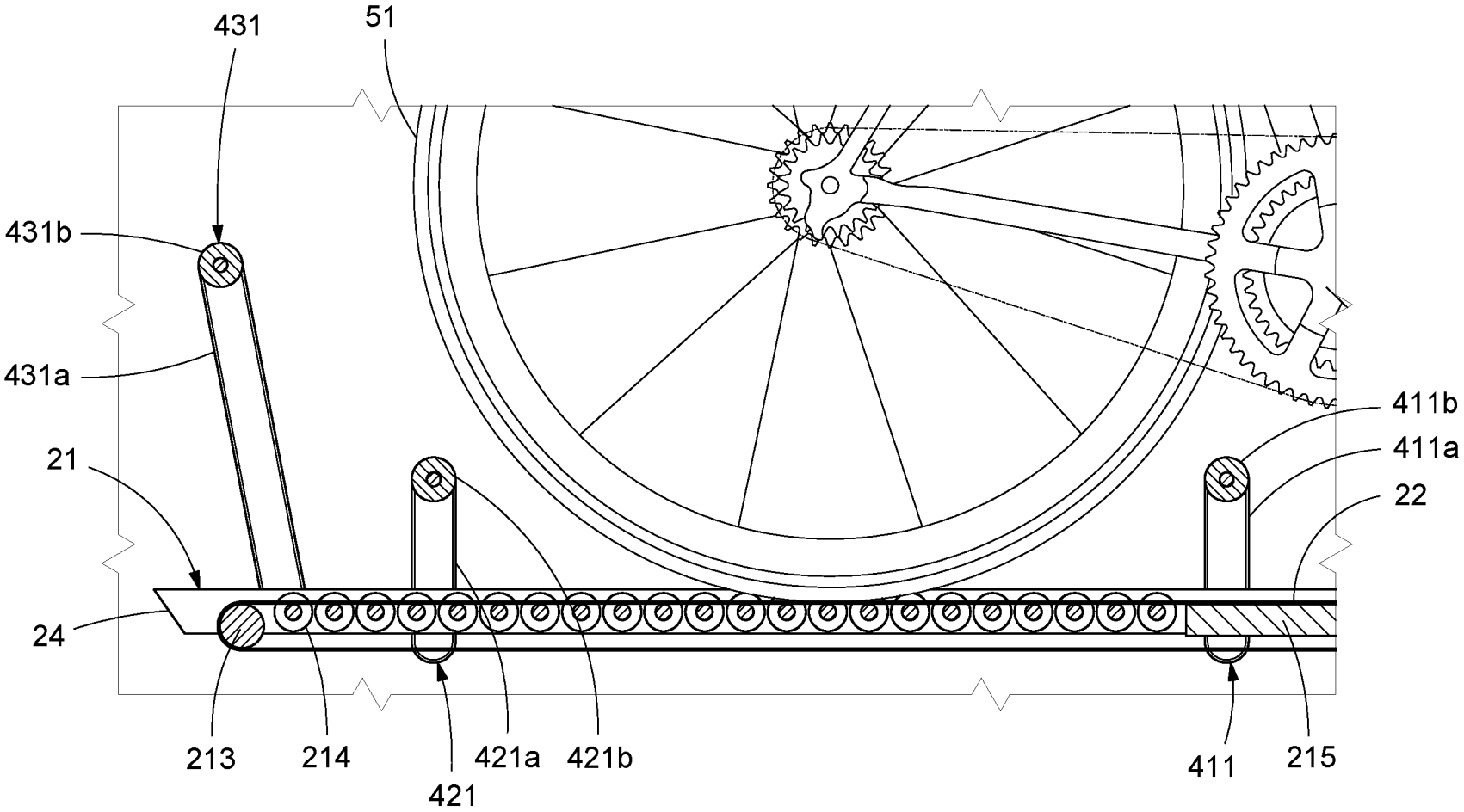
FIG. 4 is an enlarged view of a part of FIG. 3.

The electric treadmill 20 mainly comprises a base 21, an endless conveyor belt 22, and an actuator 23. The base 21 primarily includes a frame 211, and a front roller 212, a rear roller 213 and multiple inner rollers 214, which are rotatably disposed within the frame 211 respectively, and a support plate 215 fixed within the frame 211. The endless conveyor belt 22 extends around all front, rear, inner rollers 212, 213, 214, and the support plate 215. The actuator 23 is positioned on the frame 211 and drives the endless conveyor belt 22 to run cyclically via a transmission device (not shown). For the actuator 23, an electric motor (not shown) in cooperation with or without a gearbox and/or a transmission belt may be used. The electric treadmill 20 in the present disclosure is similar to a treadmill known in the art, but is used for the user to ride a bicycle 50 facing the front direction D1 on the endless conveyor belt 22. That is, the wheels of the bicycle 50 are in contact with and supported on the surface of the endless conveyor belt 22, as shown in FIG. 4. For simplification of the drawings and concise illustrative purpose, the drawings of the present invention only depict the basic structure of the electric treadmill 20 while other mechanisms unrelated to the technical features of the present disclosure, such as the legs that support the base 21 off the ground, the transmission device that drives the endless conveyor belt 22, and the lifting mechanism for raising and lowering the base 21 to provide an inclined climbing effect, are not shown in the drawings. However, these components are similar to those used in conventional treadmills, and would be readily understood by those skilled in the art.

The controller 30 is internally equipped with a circuit board (not shown), which is electrically connected with the actuator 23 of the electric treadmill 20 and can control the operation of the actuator 23, thereby further controlling the running speed of the endless conveyor belt 22. The external part of the controller 30 may include multiple buttons or a control panel (not shown) for users to operate the electric treadmill 20, performing functions such as turning the power on/off, setting features such as the inclination of the base 21, and the maximum speed limit of the endless conveyor belt 22, etc. For the sake of simplifying illustration and facilitating explanation, a rectangular block is used to represent the controller 30 in the drawings of the present invention.

The sensing unit 40 of the present embodiment comprises a first sensing device 41, a second sensing device 42, and a third sensing device 43. The first sensing device 41 includes a first swinging member 411 and a first sensor 412 capable of sensing the swing of the first swinging member 411 and then sending a first corresponding signal in responsive to the swing of the first swinging member 411 to the controller 30. The second sensing device 42 includes a second swinging member 421 and a second sensor 422 capable of sensing the swing of the second swinging member 421 and then sending a second corresponding signal in responsive to the swing of the second swinging member 421 to the controller 30. The third sensing device 43 includes a third swinging member 431 and a third sensor 432 capable of sensing the swing of the third swinging member 431 and then sending a third corresponding signal in responsive to the swing of the third swinging member 431 to the controller 30. The first, second and third swinging members 411, 421 and 431 spacedly span above the endless conveyor belt 22 of the electric treadmill 20 in a way that they are respectively able to swing back and forth relative to the base 21 of the electric treadmill 20. With this arrangement, a bicycle wheel 51 of the bicycle 50 (i.e., rear wheel in this embodiment) can push the first, second and third swinging members 411, 421, 431 to swing when the bicycle 50 is running on the endless conveyor belt 22. The first, second and third sensors 412, 422, 432 are electrically and respectively connected with the controller 30, such that the controller 30 can adjust the operation of the actuator 23 and thereby adjust the running speed of the endless conveyor belt 22 based on one of the first, second and third corresponding signals transmitted by one of the first, second and third sensors 412, 422, 432, Specifically speaking, the first swinging member 411 includes two support rods 411*a* pivotally mounted on opposite left and right sides of the base 21 of the electric treadmill 20, respectively, and a transverse rod 411*b* connected between the two support rods 411*a* and thus spanning above the endless conveyor belt 22. The second swinging member 421 includes two support rods 421*a* pivotally mounted on the left and right sides of the base 21 of the electric treadmill 20, respectively, and a transverse rod 421*b* connected between the two support rods 421*a* and thus spanning above the endless conveyor belt 22. The third swinging member 431 includes two support rods 431*a* pivotally mounted on the left and right sides of the base 21 of the electric treadmill 20, respectively, and a transverse rod 431*b* connected between the two support rods 431*a* and thus spanning above the endless conveyor belt 22. The first swinging member 411 is approximately located at the middle section of the endless conveyor belt 22, and the position of the second swinging member 421 is closer to the rear end 24 of the electric treadmill 20 than that of the first swinging member 411 is. That is, the first swinging member 411 is closer to the front end 25 of the electric treadmill 20 than the second swinging member 421 is, and the third swinging member 431 is closer to the rear end 24 of the electric treadmill 20 than the second swinging member 421 is. When a user uses the bicycle trainer 10, the bicycle wheel 51 (i.e., rear wheel) of the bicycle 50 is placed between the first swinging member 411 and the second swinging member 421, and the bicycle 50 is ridden on the endless conveyor belt 22 in a way that the bicycle wheel 51 is not in contact with both the first swinging member 411 and the second swinging member 421. In another aspect, for the first, second and third sensors 412, 422, 432, any sensors, such as mechanical proximity switches, optical sensing switches, electromagnetic sensing switches, etc., capable of detecting the swing (swinging motion or swinging angle) of the first, second and third swinging members 411, 421, 431 and outputting a corresponding signal according to the swing of the first, second and third swinging members 411, 421, 431 may be used. Moreover, the first, second and third sensors 412, 422, 432 may be positioned (but not limited to) at or adjacent to the pivots of the first, second and third swinging members 411, 421, 431.

Figure 5:
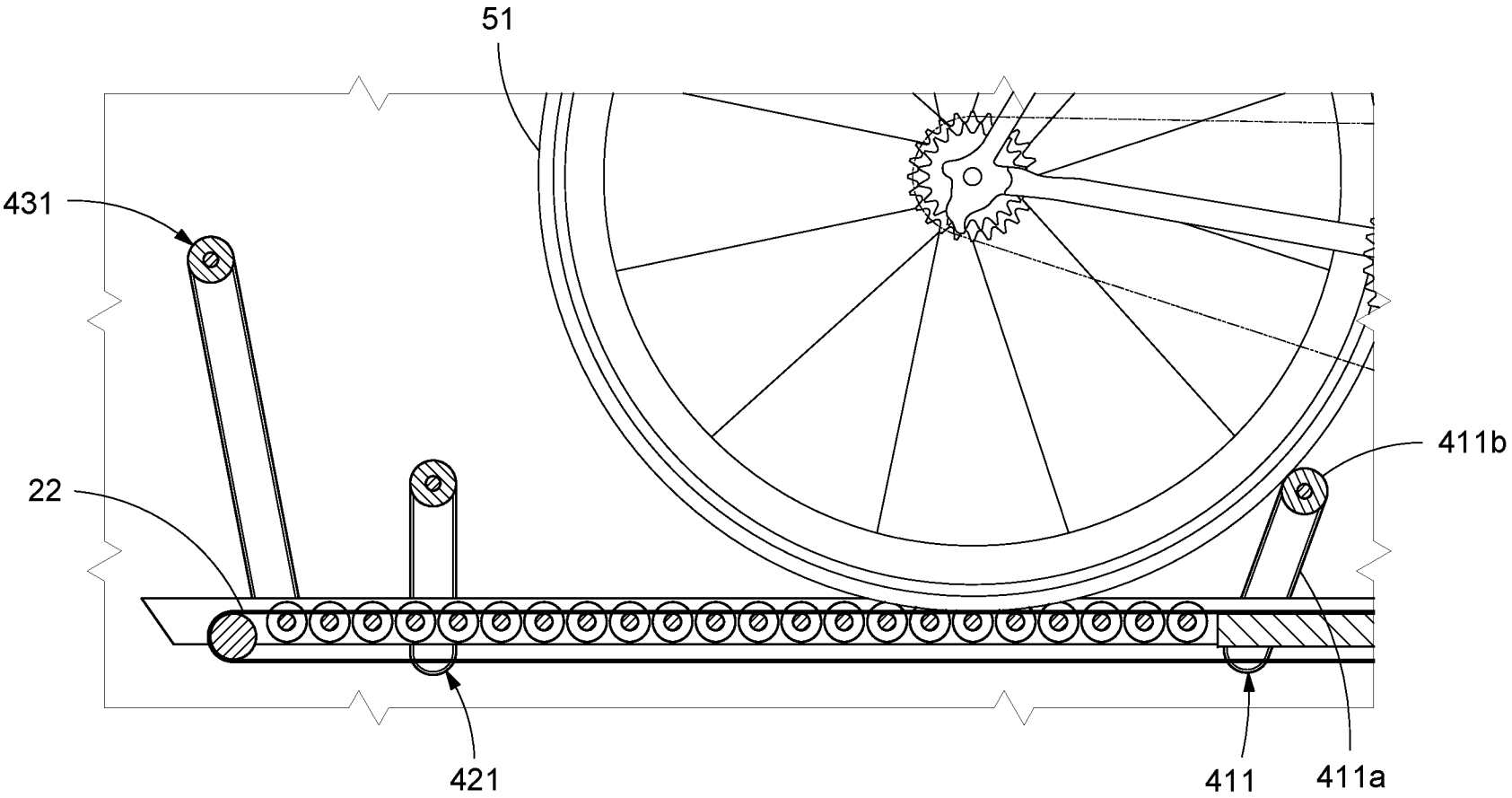
FIG. 5 is similar to FIG. 4, but showing a first swinging member of the bicycle trainer of the preferred embodiment of the present invention is pushed by a bicycle wheel.

During riding, if the riding speed of the user is approximately matched with the running speed of the endless conveyor belt 22, the user can ride the bicycle 50 on the endless conveyor belt 22 in site, i.e., the bicycle wheel 51 is distanced from both the first and second swing members 411 and 421, to conduct riding training. When the user increases the riding speed, causing the speed of the bicycle 50 to be faster than the running speed of the endless conveyor belt 22, the bicycle 50 will gradually move towards the front direction D1, and the bicycle wheel 51 will then push against the transverse rod 411*b* of the first swinging member 411, causing the two support rods 411*a* of the first swinging member 411 to swing forward simultaneously, as shown in FIG. 5. At this time, the first sensor 412 sends a first corresponding single to the controller 30 upon detecting the swing of the first swinging member 412, and as soon as the controller 30 receives the first corresponding signal transmitted from the first sensor 412, the controller 30 sends a command to the actuator 23 to increase the running speed of the endless conveyor belt 22 until the running speed of the endless conveyor belt 22 matches the instant riding speed of the user. In this way, the bicycle 50 will no longer move towards the front direction D1, thereby avoiding the bicycle 50 from rushing out of the bicycle trainer 10 to cause danger. Furthermore, increasing the running speed of the endless conveyor belt 22 can reestablish a balance state that the riding speed of the bicycle 50 and the running speed of the endless conveyor belt 22 are approximately matched with each other again, so that the bicycle wheel 51 (i.e., the rear wheel) can return to the position between the first and second swinging members 411, 421, allowing the user to continue riding on the endless conveyor belt 22 in site again with the instant riding speed to continue riding training under an increased riding training intensity.

Figure 6:
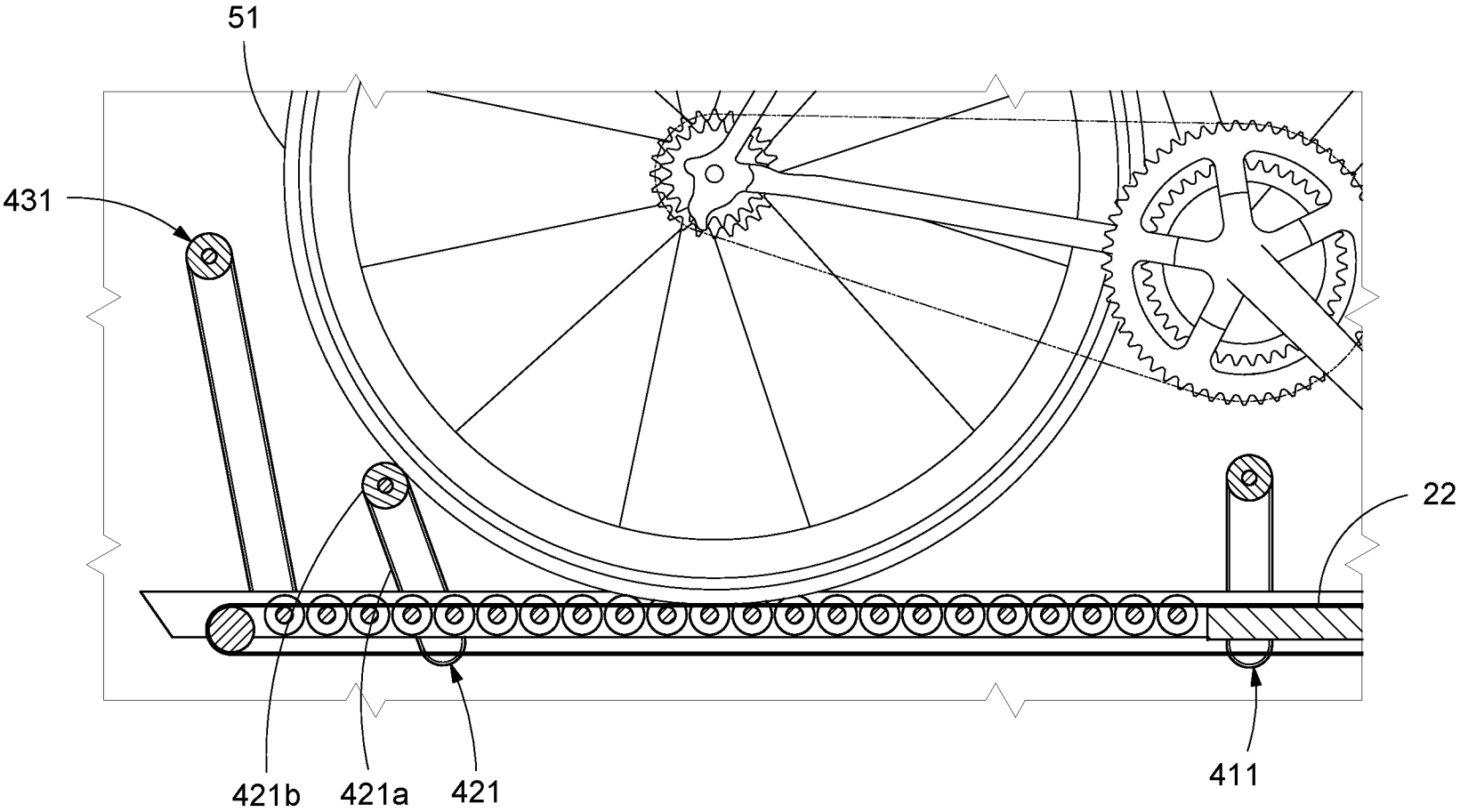
FIG. 6 is similar to FIG. 4, but showing a second swinging member of the bicycle trainer of the preferred embodiment of the present invention is pushed by the bicycle wheel.

On the other hand, during riding, when the user reduces the riding speed, causing the speed of the bicycle 50 to be slower than the running speed of the endless conveyor belt 22, the bicycle 50 will move rearward on the endless conveyor belt 22 towards the rear direction D2, and the bicycle wheel 51 will then push against the transverse rod 421*b* of the second swinging member 421, causing the two support rods 421*a* of the second swinging member 421 to swing backward simultaneously, as shown in FIG. 6. At this time, the second sensor 422 sends a second corresponding signal to the controller 30 upon detecting the swing of the second swinging member 422, and as soon as the controller 30 receives the second corresponding signal transmitted from the second sensor 422, the controller 30 sends a command to the actuator 23 to decrease the running speed of the endless conveyor belt 22 until the running speed of the endless conveyor belt 22 matches the instant riding speed of the user. In this way, the bicycle 50 will no longer move towards the rear direction D2, thereby avoiding the bicycle from rushing out of the bicycle trainer 10 to cause any danger. Moreover, reducing the running speed of the endless conveyor belt 22 can reestablish a balance state that the riding speed of the bicycle and the running speed of the endless conveyor belt 22 are approximately matched with each other again, so that the bicycle wheel 51 (i.e., the rear wheel) can return to the position between the first and second swinging members 411, 412, allowing the user to continue riding on the endless conveyor belt 22 in site again with the instant riding speed to continue riding training under a decrease riding training intensity.

Figure 7:
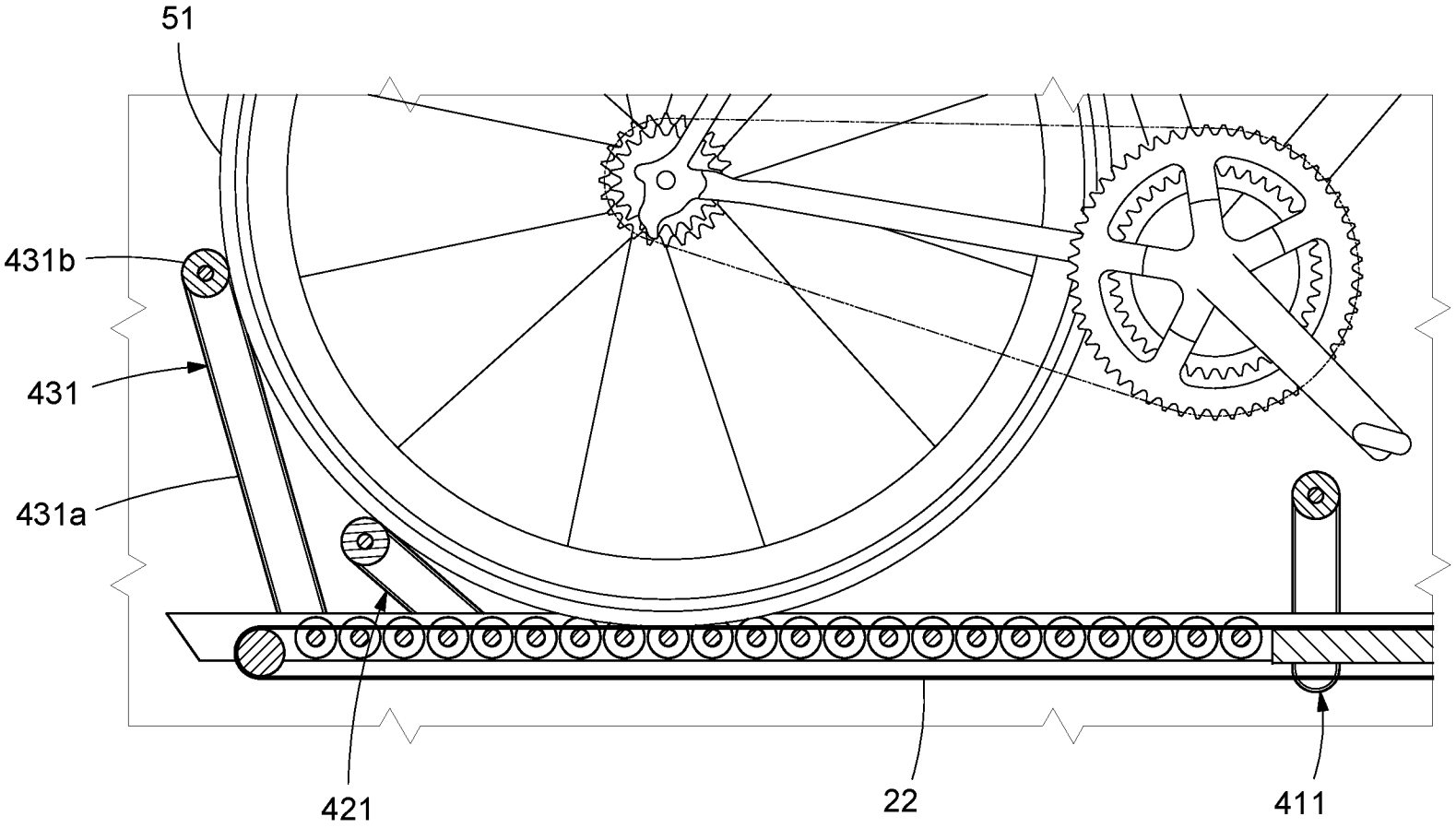
FIG. 7 is similar to FIG. 4, but showing a third swinging member of the bicycle trainer of the preferred embodiment of the present invention is pushed by the bicycle wheel.

Additionally, during riding, when the speed of the bicycle 50 rapidly decreases, such as during emergency braking, the bicycle 50 will quickly move rearward on the endless conveyor belt 22 towards the rear direction D2, causing the bicycle wheel 51 to bump against the transverse rod 421*b* of the second swinging member 421 first and then bump against the transverse rod 431*b* of the third swinging member 431, causing the two support rods 431*a* of the third swinging member 431 to swing backward simultaneously, as shown in FIG. 7. At this time, the third sensor 432 sends a third corresponding signal to the controller 30, and as soon as the controller 30 receives the third corresponding signal transmitted from the third sensor 432, the controller 30 sends a command to the actuator 23 to immediately stop the operation of the endless conveyor belt 22, thereby avoiding the danger of the bicycle 50 rushing out of the bicycle trainer 10. In this embodiment, the height of the third swinging member 431 is higher than that of the second swinging member 421, such that the bicycle wheel 51 will quickly bump the third swinging member 431 after the bicycle wheel 51 pushes against the second swinging member 421, thereby enabling the controller 30 to effectively control the endless conveyor belt 22 to stop so as to avoid danger.

Figure 8:
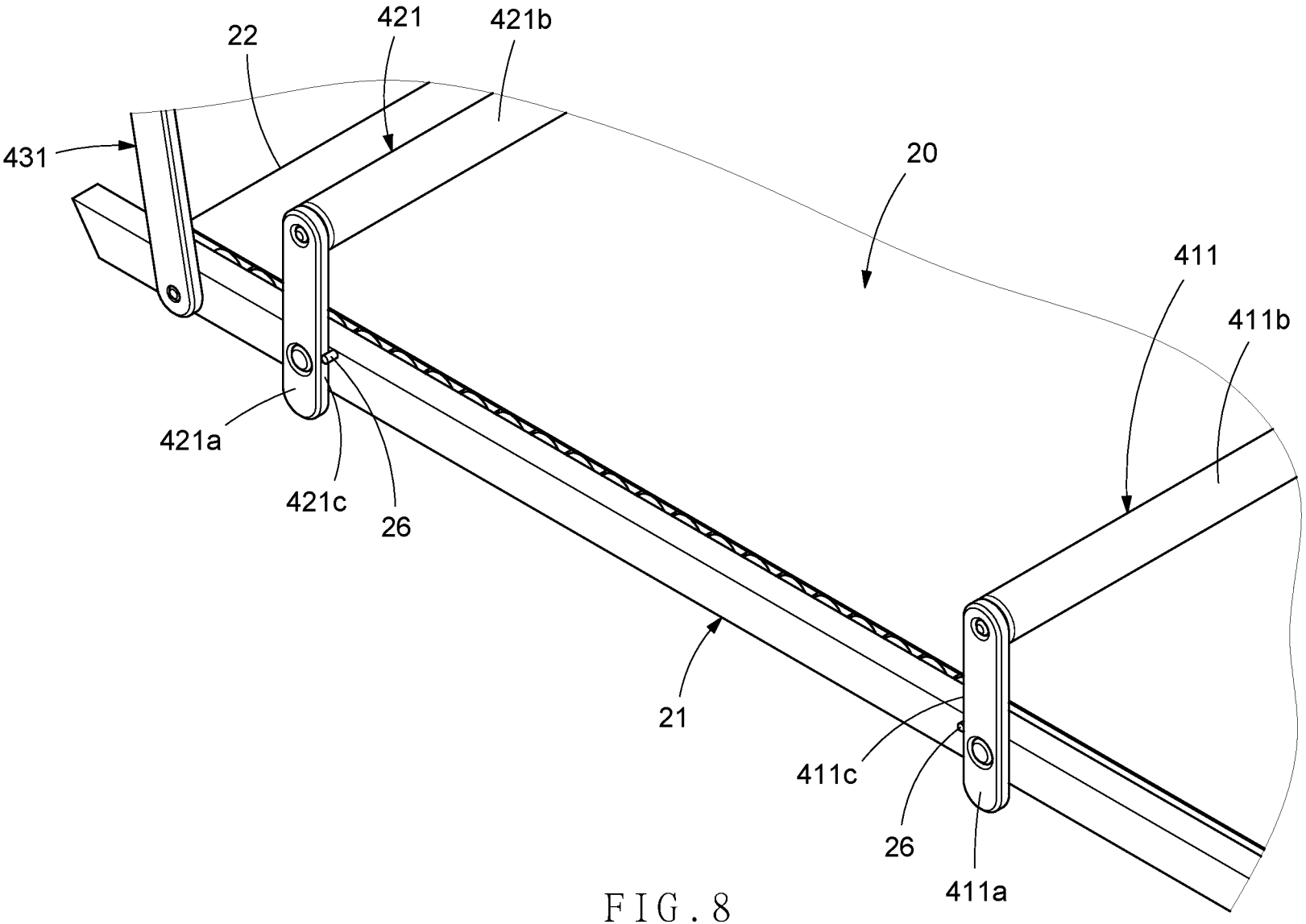
FIG. 8 is an enlarged view of a part of FIG. 1.

Referring to FIGS. 1 and 8, in the present embodiment, the base 21 of the electric treadmill 20 is equipped with two stoppers 26 on each of the left and right sides. The rear side 411*c* of each support rod 411*a* of the first swinging member 411 is adjacent to a stopper 26, so that the first swinging member 411 will only swing forward when pushed by the wheel 51, and will not swing backward from the position shown in FIG. 4. A returning spring (not shown) may be provided on the first swinging member 411 for returning the first swinging member 411 back to the initial position shown in FIG. 4 when the first swinging member 400 is no longer pushed by the bicycle wheel 51. The front side 421*c* of each support rod 421*a* of the second swinging member 421 is adjacent to a stopper 26, so that the second swinging member 421 will only swing backward when pushed by the bicycle wheel 51, and will not swing forward from the position shown in FIG. 4. Similarly, a returning spring (not shown) may be provided on the second swinging member 421 to return the second swinging member 421 back to the initial position shown in FIG. 4 when the second swinging member 421 is no longer pushed by the bicycle wheel 51.

As discussed above, the bicycle trainer 10 of the present invention allows the user to ride a bicycle 50 on the endless conveyor belt 22, experiencing a sensation similar to riding on a real road surface, thus achieving a good simulation effect of actual riding. Additionally, the bicycle trainer 10 of the present invention can control the running speed of the endless conveyor belt 22 through the controller 30, providing the user with a desired riding speed for training. Moreover, when the user increases (or decreases) the riding speed during riding training on the bicycle trainer 10 to cause a significant difference between the riding speed of the bicycle 50 and the running speed of the endless conveyor belt 22, the sensing unit 40 will activate the controller 30 to accordingly adjust the running speed of the endless conveyor belt 22 to match the instant riding speed of the user, thereby avoiding the bicycle 50 from rushing out of the bicycle trainer 10 to cause danger, and allowing the user to adjust the riding speed during the training process to achieve a good training effect.

The invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. A bicycle trainer comprising:

an electric treadmill including a base, an endless conveyor belt disposed on the base, and an actuator driving the endless conveyor belt to run cyclically, wherein the electric treadmill defines a front direction and a rear direction, and is configured for a user to ride a bicycle on the endless conveyor belt facing the front direction;

a controller electrically connected with the actuator of the electric treadmill to control an operation of the actuator to thereby control a running speed of the endless conveyor belt; and a sensing unit comprising at least one swinging member and at least one sensor electrically connected with the controller for sensing a swing of the at least one swinging member and sending a corresponding signal in responsive to the swing to the controller;

wherein the at least one swinging member is disposed across the electric treadmill and swingable back and forth relative to the electric treadmill, such that the at least one swinging member is pushable by a bicycle wheel to swing;

wherein the controller adjusts the running speed of the endless conveyor belt based on the corresponding signal transmitted from the at least one sensor;

wherein the at least one swinging member of the sensing unit comprises a first swinging member and a second swinging member, which are configured in a way that the bicycle wheel is located between the first swinging member and the second swinging member when the bicycle is placed on the endless conveyor belt;

wherein the at least one sensor of the sensing unit comprises a first sensor for sensing a swing of the first swinging member and sending a first corresponding signal in responsive to the swing of the first swinging member, and a second sensor for sensing a swing of the second swinging member and sending a second corresponding signal in responsive to the swing of the second swinging member, wherein the electric treadmill has a front end facing the front direction, and a rear end facing the rear direction;

wherein the first swinging member is closer to the front end of the electric treadmill than the second swinging member is;

wherein when the first swinging member swings forward, the controller increases the running speed of the endless conveyor belt based on the first corresponding signal transmitted by the first sensor;

wherein when the second swinging member swings backward, the controller decreases the running speed of the endless conveyor belt based on the second corresponding signal transmitted by the second sensor;

wherein each of the first swinging member and the second swinging member comprises two support rods pivotally mounted on the base of the electric treadmill, and a transverse rod connected with the two support rods in a way that the transverse rod spans above the endless conveyor belt for being pushed by the bicycle wheel to cause the support rods to swing simultaneously; the base of the electric treadmill is provided with a plurality of stoppers in a way that one of the stoppers is located adjacent to a rear side of one of the support rods of the first swinging member, and one of the stoppers is located adjacent to a front side of one of the support rods of the second swinging member.

2. The bicycle trainer of claim 1, wherein the at least one swinging member of the sensing unit further comprises a third swinging member;

wherein the third swinging member is closer to the rear end of the electric treadmill than the second swinging member is;

wherein the at least one sensor of the sensing unit further comprises a third sensor for sensing a swing of the third swinging member and sending a third corresponding signal in responsive to the swing of the third swinging member;

wherein when the third swinging member swings backward, the controller stops the endless conveyor belt based on the third corresponding signal transmitted by the third sensor.

3. The bicycle trainer of claim 2, wherein a height of the third swinging member is higher than that of the second swinging member.

4. A bicycle trainer comprising:

an electric treadmill including a base, an endless conveyor belt disposed on the base, and an actuator driving the endless conveyor belt to run cyclically, wherein the electric treadmill defines a front direction and a rear direction, and is configured for a user to ride a bicycle on the endless conveyor belt facing the front direction;

a controller electrically connected with the actuator of the electric treadmill to control an operation of the actuator to thereby control a running speed of the endless conveyor belt; and a sensing unit comprising at least one swinging member and at least one sensor electrically connected with the controller for sensing a swing of the at least one swinging member and sending a corresponding signal in responsive to the swing to the controller;

wherein the at least one swinging member is disposed across the electric treadmill and swingable back and forth relative to the electric treadmill, such that the at least one swinging member is pushable by a bicycle wheel to swing;

wherein the controller adjusts the running speed of the endless conveyor belt based on the corresponding signal transmitted from the at least one sensor;

wherein the at least one swinging member of the sensing unit comprises a first swinging member and a second swinging member, which are configured in a way that the bicycle wheel is located between the first swinging member and the second swinging member when the bicycle is placed on the endless conveyor belt;

wherein the at least one sensor of the sensing unit comprises a first sensor for sensing a swing of the first swinging member and sending a first corresponding signal in responsive to the swing of the first swinging member, and a second sensor for sensing a swing of the second swinging member and sending a second corresponding signal in responsive to the swing of the second swinging member;

wherein the electric treadmill has a front end facing the front direction, and a rear end facing the rear direction;

wherein the first swinging member is closer to the front end of the electric treadmill than the second swinging member is;

wherein when the first swinging member swings forward, the controller increases the running speed of the endless conveyor belt based on the first corresponding signal transmitted by the first sensor;

wherein when the second swinging member swings backward, the controller decreases the running speed of the endless conveyor belt based on the second corresponding signal transmitted by the second sensor;

wherein the at least one swinging member of the sensing unit further comprises a third swinging member;

wherein the third swinging member is closer to the rear end of the electric treadmill than the second swinging member is;

wherein the at least one sensor of the sensing unit further comprises a third sensor for sensing a swing of the third swinging member and sending a third corresponding signal in responsive to the swing of the third swinging member;

wherein when the third swinging member swings backward, the controller stops the endless conveyor belt based on the third corresponding signal transmitted by the third sensor.

5. The bicycle trainer of claim 4, wherein a height of the third swinging member is higher than that of the second swinging member.

* * * * *